US010648218B1

(12) United States Patent
Schroeder et al.

(10) Patent No.: US 10,648,218 B1
(45) Date of Patent: May 12, 2020

(54) REFRIGERATOR WITH PUSH-TO-OPEN DOOR OPENER

(71) Applicant: Haier US Appliance Solutions, Inc., Wilmington, DE (US)

(72) Inventors: Michael Goodman Schroeder, Louisville, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/427,426

(22) Filed: May 31, 2019

(51) Int. Cl.
*E05F 15/75* (2015.01)
*E05F 3/18* (2006.01)
*F25D 23/02* (2006.01)

(52) U.S. Cl.
CPC ..... *E05F 15/75* (2015.01); *E05F 3/18* (2013.01); *F25D 23/028* (2013.01); *E05Y 2900/31* (2013.01); *F25D 2600/00* (2013.01)

(58) Field of Classification Search
CPC ..... F25D 23/028; F25D 2323/02; F25D 2600/06; E05F 15/75; E05Y 2900/31
USPC ..... 49/276–278
See application file for complete search history.

(56) References Cited

U.S. PATENT DOCUMENTS 8,469,469 B2 6/2013 Kim et al.
9,062,911 B2 * 6/2015 Keller ..... F25D 17/047
9,410,735 B2 8/2016 Maas
9,534,829 B2 1/2017 Held
2014/0306596 A1 * 10/2014 Linke ..... E05F 15/611 312/405
2018/0187470 A1 * 7/2018 Song, Il ..... E05F 15/619
2018/0347892 A1 * 12/2018 Kim ..... E05F 15/619

FOREIGN PATENT DOCUMENTS

JP 2001174146 A 6/2001
JP 2004003774 A * 1/2004 ..... E05F 15/622
KR 102012000377 A * 1/2012 ..... E05B 17/0029
WO WO-2007042933 A1 * 4/2007 ..... E05F 11/54

* cited by examiner

*Primary Examiner* — Andrew M Roersma
(74) *Attorney, Agent, or Firm* — Dority & Manning, P.A.

(57) ABSTRACT

A refrigerator appliance includes a cabinet defining a food storage chamber. A door is positioned on the cabinet and is movable between a closed position and an open position. A door opener includes an outer case fixedly mounted to the cabinet. The door opener also includes an inner case within the outer case that is movable relative to the outer case. A finger extends from the door opener towards the door. The door opener also includes a sensor that detects relative movement between the inner case and the outer case. The finger is positioned in contact with an inner surface of the door when the door is in the closed position and the door opener is in a zero position. The sensor detects movement of the inner case from the zero position of the door opener towards the back portion of the cabinet along the transverse direction.

17 Claims, 7 Drawing Sheets

REFRIGERATOR WITH PUSH-TO-OPEN DOOR OPENER

FIELD OF THE INVENTION

The subject matter of the present disclosure relates generally to appliances having a cabinet and a door. For example, such appliances may include refrigerator appliances.

BACKGROUND OF THE INVENTION

Refrigerator appliances generally include a cabinet that defines one or more chilled chambers for receipt of food items for storage. One or more insulated, sealing doors are provided for selectively enclosing the chilled food storage chamber(s). Generally, the door(s) are movable between a closed position and an open position for accessing food items stored therein by pulling on the door(s), such as by pulling on a handle on the door.

In some instances, for example, when a user's hands are full of groceries to load into the refrigerator or are covered in raw food ingredients from cooking, etc., a user may prefer to open the door without having to grasp the door, or a part of the door such as the handle, in the user's hand. In particular, a user may prefer to nudge or push on the door to open the door.

Accordingly, a refrigerator having an improved means for opening a door thereof would be useful. In particular, a refrigerator appliance having a means for opening a door by pushing on the door would be desirable.

BRIEF DESCRIPTION OF THE INVENTION

Aspects and advantages of the invention will be set forth in part in the following description, or may be apparent from the description, or may be learned through practice of the invention.

In a first exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber extends between a front portion and a back portion along the transverse direction. The front portion of the food storage chamber defines an opening for receipt of food items. A door is positioned at the front portion of the food storage chamber and is movable between a closed position and an open position. The door thus selectively sealingly encloses the food storage chamber in the closed position and provides access to the food storage chamber in the open position. A door opener is positioned in the cabinet. The door opener includes an outer case fixedly mounted to the cabinet. The door opener also includes an inner case which is positioned within the outer case and is movable relative to the outer case. A finger extends through the inner case and the outer case of the door opener towards the door. The door opener also includes a sensor that detects relative movement between the inner case and the outer case. The finger is positioned in contact with an inner surface of the door when the door is in the closed position and the door opener is in a zero position. The sensor detects movement of the inner case from the zero position of the door opener towards the back portion of the cabinet along the transverse direction.

In a second exemplary embodiment, a door opener for a refrigerator appliance is provided. The door opener defines a vertical direction, a lateral direction, and a transverse direction. The vertical, lateral, and transverse directions are mutually perpendicular. The refrigerator appliance includes a cabinet defining a food storage chamber and a door mounted on the cabinet. The door is movable between a closed position and an open position to selectively sealingly enclose the food storage chamber in the closed position and provide access to the food storage chamber in the open position. The door opener includes an outer case fixedly mountable to the cabinet. The door opener also includes an inner case positioned within the outer case and movable relative to the outer case. A finger extends through the inner case and the outer case towards the door of the refrigerator appliance. The door opener also includes a sensor configured to detect relative movement between the inner case and the outer case. The finger is positioned in contact with an inner surface of the door when the door is in the closed position and the door opener is in a zero position, wherein the sensor is configured to detect movement of the inner case from the zero position of the door opener backward along the transverse direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
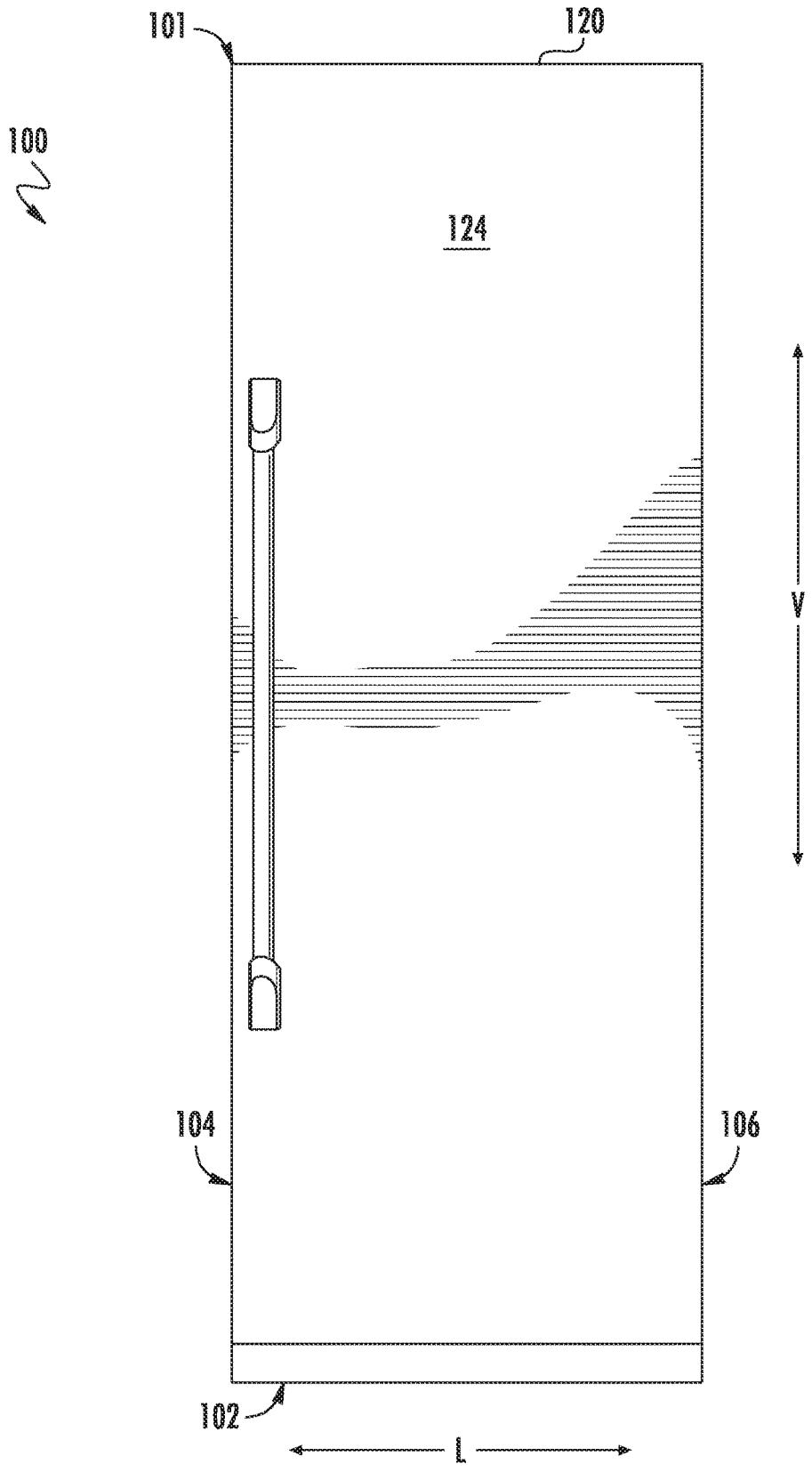
FIG. 1 provides a front elevation view of a refrigerator appliance according to an exemplary embodiment of the present subject matter with a door of the refrigerator appliance shown in the closed position.

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the door(s) and reaches into the food storage chamber(s) to access items therein.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
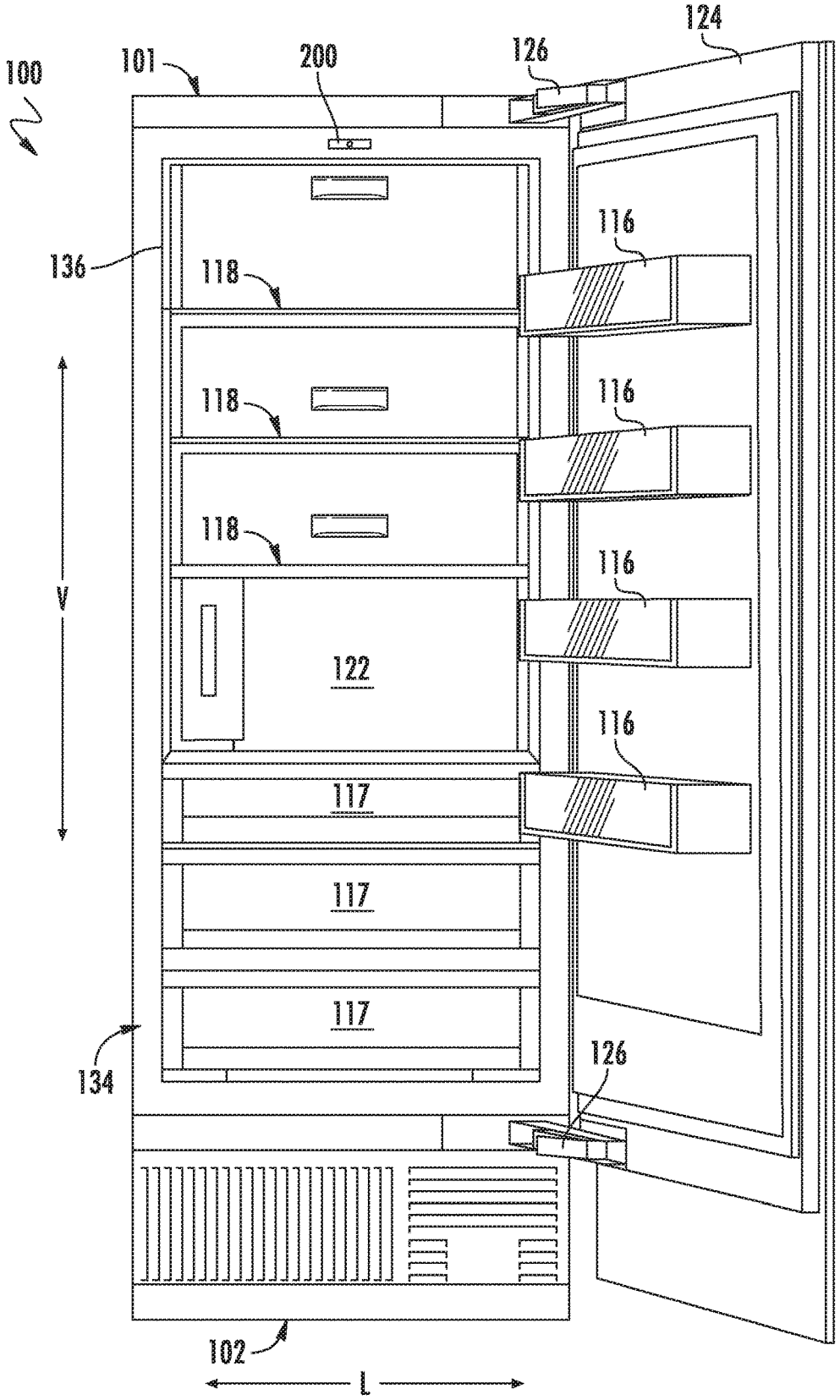
FIG. 2 provides a front elevation view of the exemplary refrigerator appliance of FIG. 1 with the door shown in an open position.
Figure 3:
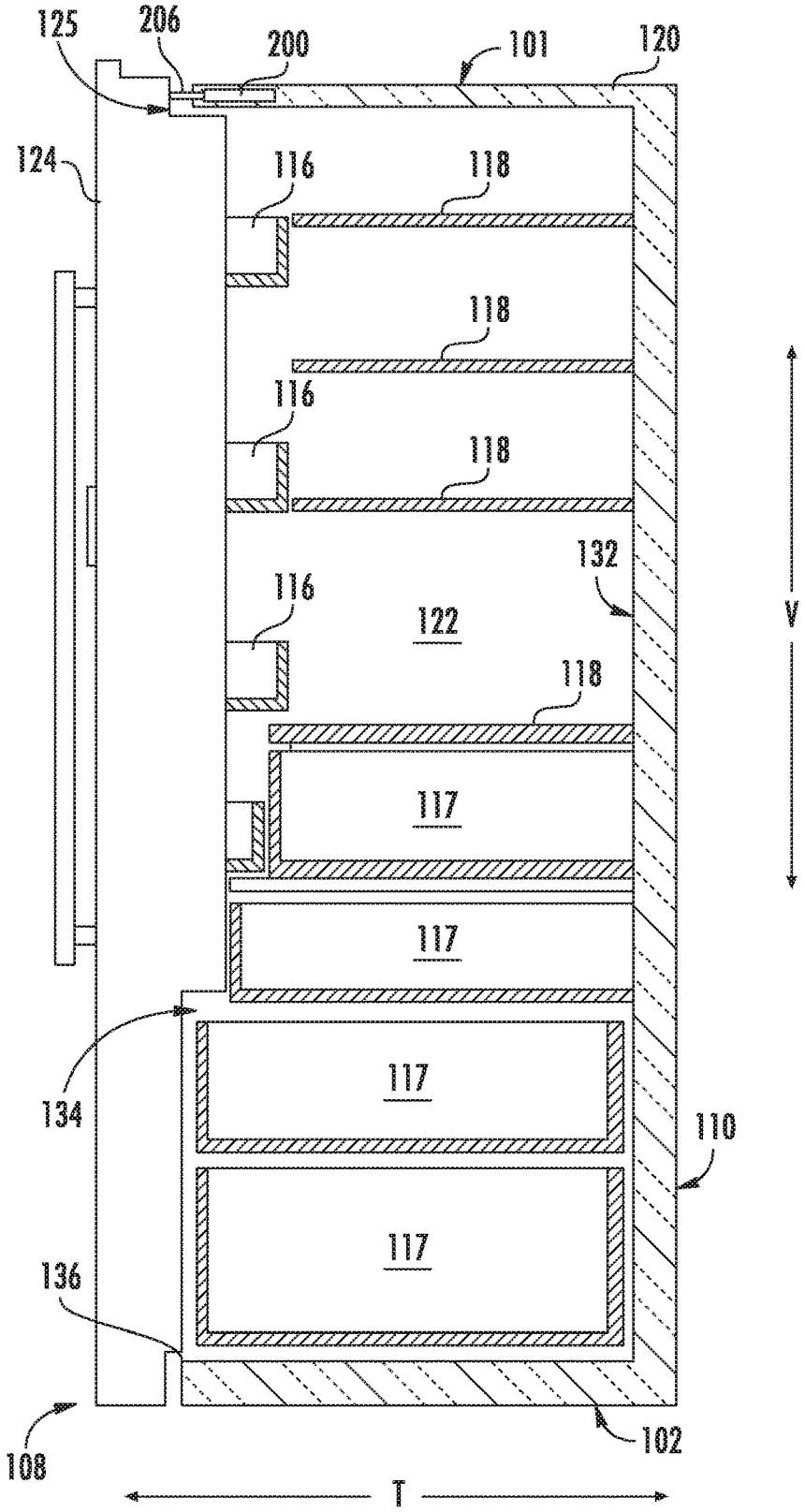
FIG. 3 provides a cross-section view of the exemplary refrigerator appliance of FIG. 1.

As illustrated in FIGS. 1 through 3, an exemplary refrigerator appliance 100 has an insulated housing or cabinet 120 that defines a food storage chamber 122. A door 124 is provided to selectively sealingly enclose the food storage chamber 122 when in a closed position (FIG. 1) and provide access to the food storage chamber 122 when in an open position (FIG. 2). The door 124 is rotatably mounted to the cabinet 120, such as by one or more hinges 126 (FIG. 2), to rotate between the open position and the closed position.

Refrigerator appliance 100 defines a vertical direction V, a lateral direction L, and a transverse direction T (FIG. 3), each mutually perpendicular to one another. As may be seen in FIGS. 1 through 3, the cabinet or housing 120 extends between a top 101 and a bottom 102 along the vertical direction V, between a left side 104 and a right side 106 along the lateral direction L, and between a front 108 (FIG. 3) and a rear 110 (FIG. 3) along the transverse direction T. As may be seen in FIGS. 2 and 3, the food storage chamber 122 extends between a front portion 134 and a back portion 132 along the transverse direction T. The front portion 134 of the food storage chamber 122 defines an opening 136 for receipt of food items. The food storage chamber 122 is a chilled chamber 122 for receipt of food items for storage. As used herein, the chamber may be "chilled" in that the chamber is operable at temperatures below room temperature, e.g., less than about seventy-five degrees Fahrenheit (75° F.). One of ordinary skill in the art will recognize that the food storage chamber 122 may be chilled by a sealed refrigeration system, such that the food storage chamber 122 may be operable at or about the temperatures described herein by providing chilled air from the sealed system. The structure and function of such sealed systems are understood by those of ordinary skill in the art and are not described in further detail herein for the sake of brevity and clarity.

Refrigerator door 124 is rotatably mounted, e.g., hinged, to an edge of cabinet 120 for selectively accessing the fresh food storage chamber 122 within the cabinet 120. Refrigerator door 124 may be mounted to the cabinet 120 at or near the front portion 134 of the food storage chamber 122 such that the door 124 moves, e.g., rotates via hinges 126, between the closed position (FIG. 1) and the open position (FIG. 2). In the closed position of FIG. 1, the door 124 sealingly encloses the food storage chamber 122. Additionally, one or more gaskets and other sealing devices, which are not shown but will be understood by one of ordinary skill in the art, may be provided to promote sealing between the door 124 and the cabinet 120. In the open position of FIG. 2, the door 124 permits access to the fresh food storage chamber 122.

As shown for example in FIGS. 2 and 3, various storage components may be mounted within the food storage chamber 122 to facilitate storage of food items therein as will be understood by those skilled in the art. In particular, the storage components include bins 116, drawers 117, and shelves 118 that are mounted within fresh food chamber 122. Bins 116, drawers 117, and shelves 118 are configured for receipt of food items (e.g., beverages and/or solid food items) and may assist with organizing such food items.

As depicted, cabinet 120 defines a single chilled chamber 122 for receipt of food items for storage. In the present example, the single chilled chamber 122 is a fresh food chamber 122. In some embodiments, the chilled chamber may be a freezer chamber and/or the refrigerator appliance 100 may include one or more additional chilled chambers for receipt of various food items and storage of such items at various temperatures as desired. For example, the refrigerator appliance 100 may include one or more chilled chambers configured for deep freeze (e.g., at about 0° F. or less) storage, or configured for chilling, e.g., produce or wine, at relatively warmer temperatures such as about 60° F. or more, as well as any suitable temperatures between the stated examples. In various exemplary embodiments, the chilled chamber 122 may be selectively operable at any number of various temperatures and/or temperature ranges as desired or required per application, and/or the refrigerator appliance 100 may include one or more additional chambers selectively operable at any suitable food storage temperature.

The illustrated exemplary refrigerator appliance 100 is generally referred to as a single-door or single-purpose refrigerator, sometimes also referred to as a column refrigerator. It is recognized, however, that the benefits of the present disclosure apply to other types and styles of refrigerators such as, for example, a bottom mount refrigerator, a top mount refrigerator, a side-by-side style refrigerator, or a freezer appliance. Consequently, the description set forth herein is for illustrative purposes only and is not intended to be limiting in any aspect to a particular refrigerator chamber configuration. Additionally, door openers as described herein may be useful in other types of appliances such as microwave oven appliances, clothes washer/dryer appliances, etc., and/or other contexts wherever the disclosed features may be desired.

As may be seen in FIGS. 2 and 3, the refrigerator appliance 100 may include a door opener 200. The door opener 200 may be positioned in the cabinet 120. For example, the door opener 200 may be positioned in the cabinet 120 proximate the front 108 of the cabinet 120 and the opening 136 of the food storage chamber 122. In the illustrated exemplary embodiment, the door opener 200 is positioned proximate the top 101 of the cabinet 120 along the vertical direction V and is generally centered along the lateral direction L. That is, the example door opener 200, as best seen in FIG. 2, is positioned at or about a lateral midpoint of the cabinet 120 and/or the opening 136 of the food storage chamber 122. In other embodiments, the door opener 200 may be positioned at other locations within the cabinet 120, such as near the bottom 102 along the vertical direction V. In some embodiments, centering the door opener 200 along the lateral direction L may advantageously provide flexibility in mounting the door 124. For example, the illustrated refrigerator appliance 100 includes the door 124 mounted on the right side 106. In other embodiments, the door 124, e.g., the hinges 126, may be mounted to the cabinet 120 at or near the left side 104. In embodiments where the door opener 200 is centered along the lateral direction L, the door opener 200 will apply generally the same opening force to the door 124 when the door 124 is mounted to either left side 104 or right side 106, e.g., the moment arm or leverage applied to the door 124 as it rotates about the hinges 126 will be generally the same.

Figure 4:
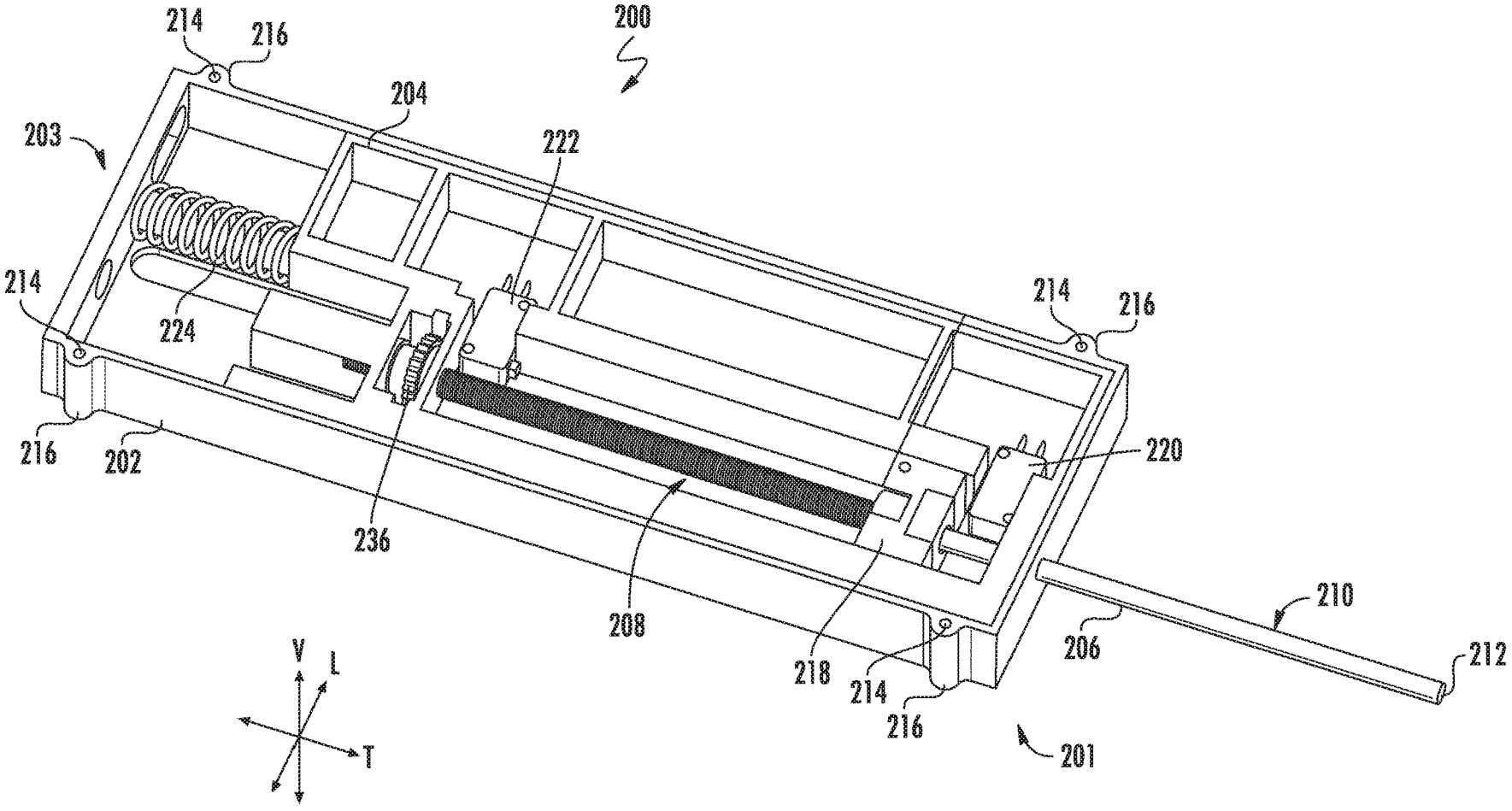
FIG. 4 provides a perspective view of an exemplary door opener which may be incorporated into appliances such as the refrigerator appliance of FIG. 1.

Turning now to FIG. 4, the door opener 200 defines a vertical direction V, a lateral direction L, and a transverse direction T. The vertical direction V, the lateral direction L, and the transverse direction T are mutually perpendicular. The door opener 200 may include an outer case 202 extending from a back portion 203 to a front portion 201 along the transverse direction T. The door opener 200 is generally oriented and installed in the refrigerator appliance 100 such that the corresponding directions are generally aligned, e.g., are within ten degrees of each other. For example, the door opener 200 may be positioned, e.g., mounted, within the cabinet 120 such that the vertical direction V defined by the door opener 200 is generally the same as the vertical direction V defined by the refrigerator appliance 100, the lateral direction L defined by the door opener 200 is generally the same as the lateral direction L defined by the refrigerator appliance 100, and the transverse direction T defined by the door opener 200 is generally the same as the transverse direction T defined by the refrigerator appliance 100. Additionally, the front portion 201 of the outer case 202 is generally proximate or aligned with the front 108 of the cabinet 120 along the transverse direction T, while the back portion 203 of the outer case 202 is correspondingly closer to the back 110 of the cabinet 120 than to the front 108 of the cabinet 120.

The outer case 202 of the door opener 200 may be fixedly mounted to the cabinet 120, e.g., via mechanical fasteners extending through holes 214 in mounting flanges 216 on the outer case 202. The outer case 202 may be fixedly mounted to the cabinet 120 in that the outer case 202 is not movable relative to the cabinet 120 during the ordinary and intended operation of the refrigerator appliance 100 (including the door opener 200 thereof). The door opener 200 also includes an inner case 204 positioned within the outer case 202 and movable relative to the outer case 202. The door opener 200 may include a finger 206 which includes a front portion or rod portion 210 and a threaded back portion or power screw portion 208. The finger 206, e.g., rod portion 210 thereof, may extend through the inner case 204 and the outer case 202 towards the door 124 of the refrigerator appliance 100, e.g., as may be seen in FIG. 3. In alternate embodiments, the entire finger 206 may be threaded, or the front portion 210 may be threaded while the back portion 208 is not. As depicted in FIG. 3, the door opener 200 is in a zero position. FIG. 3 illustrates the zero position of the door opener 200 relative to the refrigerator appliance 100, and FIG. 7 provides an illustration of the door opener 200 in the zero position where additional exemplary details of the door opener 200 are illustrated in FIG. 7. In contrast to the zero position of FIGS. 3 and 7, in FIGS. 4-6, the door opener 200 is illustrated in an extended position, where the finger 206 extends from the inner case 204 and the outer case 202 sufficiently to urge the door 124 away from the cabinet 120, e.g., away from the closed position illustrated in FIG. 3 and towards the open position illustrated in FIG. 2. As will be understood by those of skill in the art, the hinges 126 may be configured to move the door 124 completely to the open position shown in FIG. 2 given sufficient momentum towards the open position, and sufficient momentum may be imparted to the door 124 by the door opener 200 when the finger 206 is moved to the extended position. As seen in FIGS. 5-8 and described in more detail below with reference to FIG. 8, the door opener 200 may include a motor 226 in operative communication with the finger 206, e.g., the motor 226 may be configured to move the finger 206 between the zero position and the extended position.

Figure 5:
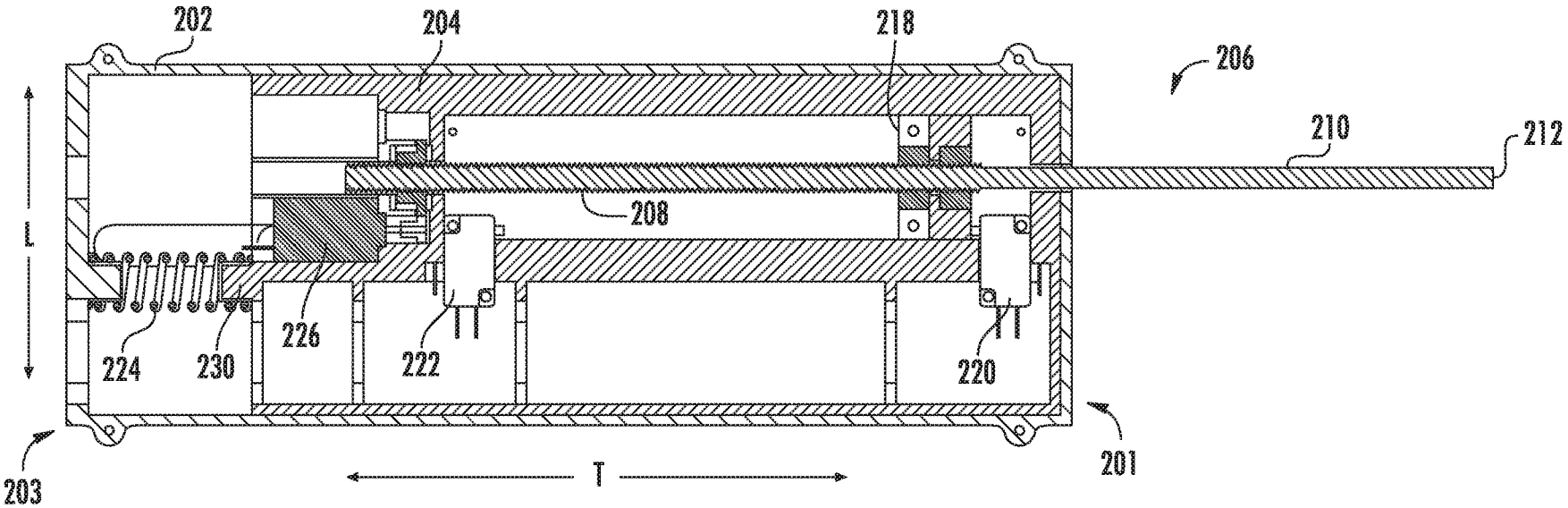
FIG. 5 provides a top-down section view of the exemplary door opener of FIG. 4.
Figure 6:
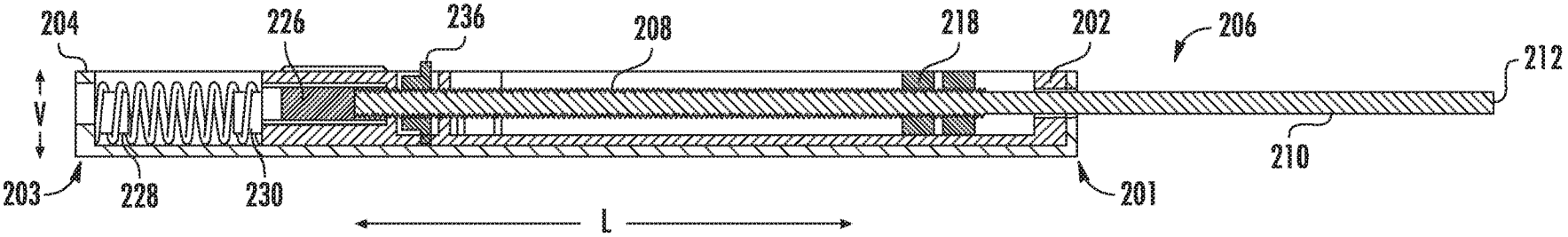
FIG. 6 provides a cross-section view of the exemplary door opener of FIG. 4.
Figure 7:
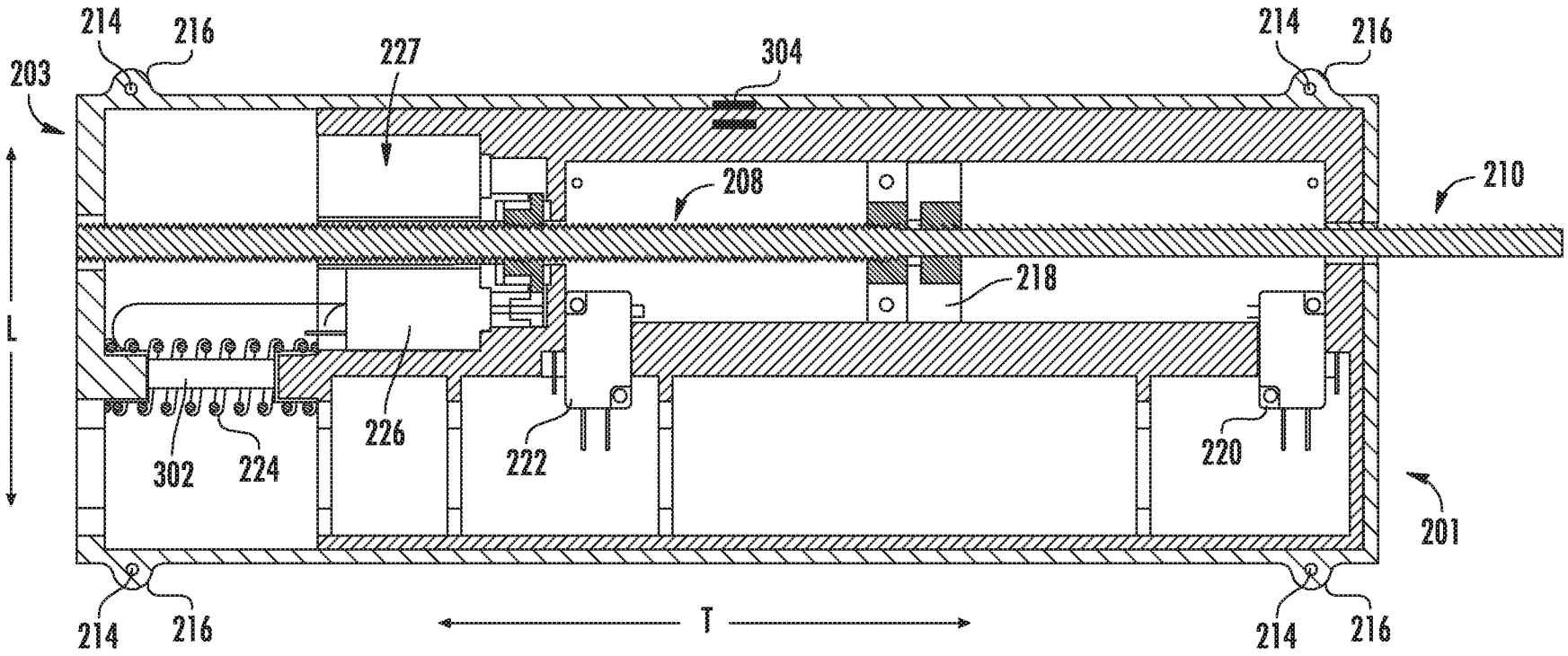
FIG. 7 provides top-down section view of the exemplary door opener of FIG. 4 in a zero position.

As may be seen in FIGS. 4-7, the inner case 204 is biased forward, e.g., towards front portion 201 of the outer case 202 along the transverse direction T, within the outer case 202 by a biasing element 224 in both the zero position and the extended position. The biasing element 224 may extend between the outer case 202 and the inner case 204, e.g., from the outer case 202 to the inner case 204 along the transverse direction T. In some embodiments, the biasing element 224 may be a coil spring 224 as illustrated. For example, as illustrated in FIGS. 5 and 6, the coil spring 224 may extend circumferentially around an outer knob 228 on the outer case 202 at one end of the coil spring 224 and may extend circumferentially around an inner knob 230 on the inner case 204 at another, opposite, end of the coil spring 224. As noted above, the door 124 may be in the open position when the door opener 200 is in the extended position illustrated in FIGS. 4-6, and the door 124 may be in the closed position when the door opener 200 is in the zero position. When the door 124 is in the closed position and the door opener 200 is in the zero position, the finger 206 will be in contact with an inner surface 125 of the door 124, as noted above and illustrated in FIG. 3. As may be seen in FIG. 7, the door opener 200 may include one or more sensors 302 and/or 304 configured to detect relative movement between the inner case 204 and the outer case 202. A push on the door 124 may result in relative movement of the inner case 204 relative to the outer case 202. For example, when the door 124 is in the closed position and the door opener 200 is in the zero position, the push on the door 124 may be transferred from the door 124 via the inner surface 125 of the door 124 to the finger 206, and from the finger 206 to the inner case 204, causing the inner case 204 to move backwards, e.g., inwards towards the interior of the cabinet 120 and/or the back portion 203 of the outer case 202, along the transverse direction T. Such movement may be sensed or detected by the one or more sensors 302 and/or 304, and the sensor(s) 302 and/or 304 may be in operative communication with the motor 226. Thus, the sensor(s) 302 and/or 304 may be configured to transmit a signal to the motor 226 when the sensor(s) 302/304 detects movement of the inner case 202 from the zero position of the door opener 200 towards the back portion 110 of the cabinet 120 and/or the back portion 203 of the outer case 202 along the transverse direction T. In turn, the motor 226 may be configured to receive the signal from the sensor(s) 302/304, to activate in response to the signal from the sensor(s) 302/304, and to move the finger 206 towards the front portion 108 of the cabinet 120 and/or the front portion 201 of the outer case 202 along the transverse direction T when the motor 226 is activated.

When the motor 226 is not activated, the finger 206 and the inner case 204 are generally locked together, e.g., the finger 206 and the inner case 204 move together along the transverse direction T in response to a transverse-oriented force acting on either the finger 206 or the inner case 204. Thus, the biasing element 224 may be configured to bias the inner case 204 and the finger 206 towards the front portion 201 of the outer case 202.

In some example embodiments, the sensor may be a linear sensor 302. For example, the linear sensor 302 may be provided in parallel with the spring 224, as illustrated in FIG. 7. The linear sensor 302 may be a linear encoder or potentiometer configured to sense and/or respond to a change in the length of the linear sensor 302, where the length of the linear sensor 302 is defined along the transverse direction T between the outer case 202 and the inner case 204, as seen in FIG. 7. In other example embodiments, the sensor may be any suitable position sensor, such as a Hall-effect sensor 304, also illustrated for example in FIG. 7. As noted above, one or more sensors may be provided. Thus, in an additional exemplary embodiment, both the linear sensor 302 and the Hall-effect sensor 304 may be provided.

The biasing force of the coil spring 224 must be overcome for the inner case 204 to move far enough relative to the outer case 202 to trip the sensor 302 and/or 304 and activate the motor 226. Thus, the coil spring 224 may advantageously prevent or minimize inadvertent activation of the door opener 200. For example, when a user (or a pet, etc.) lightly brushes against the door 124, the door opener 200 may not be triggered due to the resistance against relative inward movement of the inner case 202 by the biasing element, e.g., coil spring, 224. As another example, the biasing element, e.g., coil spring, 224 may protect the door opener 200 against door 124 slams. In some embodiments, e.g., as illustrated in FIGS. 4-6, the coil spring 224 may be positioned and configured for compression. For example, when the inner case 204 moves relative to the outer case 202 and towards the back portion 203 of the outer case 202, the coil spring 224 will be compressed. In other embodiments, the coil spring 224 may be positioned and configured for tension. For example, the coil spring 224 may extend from the outer case 202 to the inner case 204 along the transverse direction T at the front portion 201 of the outer case, such that the coil spring 224 will be stretched out and in tension when the inner case 204 moves relative to the outer case 202 and towards the back portion 203 of the outer case 202.

In operation, when a user pushes on the door 124 while the door 124 is in the closed position and the door opener 200 is in the zero position, the force of the push is transferred to the inner case 204, causing the inner case 204 to move towards the back portion 110 of the cabinet 120 and/or towards the back portion 203 of the outer case 202 along the transverse direction T relative to the outer case 202. This relative movement is detected by the sensor(s) 302/304, which transmit a signal to the motor 226, whereupon the motor 226 is activated and moves the finger 206 from the zero position to the extended position. When the door 124 is in the closed position and the finger 206 moves from the zero position to the extended position, such movement of the finger 206 overcomes the inertia of the door 124 and urges the door 124 towards the open position. The hinges 126 are configured such that once the door 124 begins to swing towards the open position, e.g., in response to the finger 206 of the door opener 200 pushing outward/forward along the transverse direction T against the inner surface 125, the momentum of the door 124 will carry the door 124 fully to the open position. Thus, after activating the door opener 200, e.g., the motor 226 thereof, the door opener 200 will be in the extended position and the door 124 will be in the open position. From this point, the door opener 200 may further be configured to automatically retract, e.g., after a predetermined period of time the motor 226 may activate in a reverse direction to return the finger 206 to the zero position.

In another example, the motor 226 may be configured to activate and move the finger 206 from the zero position to the extended position in response to a first detected push, and may further be configured to activate in the reverse direction to move the finger 206 from the extended position to the zero position in response to a subsequent, e.g., second or immediately subsequent, detected push. In such embodiments, the door opener 200 may also be a door closer. For example, the finger 206 may include a tip 212 which engages the inner surface 125 of the door 124, e.g., the tip 212 may magnetically engage the inner surface 125 of the door 124. For example, in some embodiments, a magnet may be installed on the door 124 at or just under the inner surface 125 to magnetically engage with the finger 206, which may be comprised of a ferrous material. As another example, in some embodiments, the tip 212 may be magnetic and the door 124 may comprise a ferrous material, e.g., either the door 124 itself or a ferrous contact plate on the inner surface 125, to magnetically engage the tip 212. In such embodiments, when the door 124 rotates towards the closed position while the door opener 200 is in the extended position, the inner surface 125 of the door 124 may contact the tip 212 of the finger 206, activating the door opener 200 such that the motor 226 moves the finger 206 from the extended position to the zero position, and such movement may be transferred to the door 124 by the magnetic engagement between the door 124 and finger 206, such that the finger 206 magnetically pulls the door 124 to the closed position when the finger 206 moves from the extended position to the zero position in response to the inward-swinging door 124 contacting the finger 206 when the finger 206 is in the extended position (e.g., a subsequent push as described above may be the impact of the inward-swinging door 124 on the extended finger 206).

In some embodiments, the door opener 200 may also include a translating carriage 218 locked onto the finger 206. In some embodiments, a front limit switch 220 may be provided proximate the front portion 201 of the outer case 202 and in operative communication with the motor 226. In such embodiments, the front limit switch 200 may be configured to deactivate the motor 226 when the front limit switch 220 is toggled. For example, the front limit switch 220 may be toggled when, as illustrated in FIGS. 4-6, the translating carriage 218 contacts the front limit switch 220. Thus, the extended position may be a fully extended position (as distinct from an intermediate or partially extended position) in that the maximum forward distance along the transverse direction T that the finger 206 can travel is defined by the point at which the front limit switch 220 is contacted by the translating carriage 218. It is to be understood that while the translating carriage 218 is depicted as comprising multiple distinct parts in the illustrated example embodiments, the translating carriage 218 is not limited to such construction and may also, in some embodiments, comprise a single unitary piece.

As may be seen, e.g., by comparing FIGS. 5 and 6 with FIG. 7, the finger 206 moves relative to the inner case 204 and the outer case 202 when the finger 206 moves between the zero position and the extended position, e.g., when the finger 206 is moved by the motor 226. As may be best seen in FIG. 8, the motor 226 includes a drive shaft 232 and a drive gear 234 mounted on the drive shaft 232. The drive gear 234 may have teeth thereon (which are not specifically illustrated but are well-understood by those of skill in the art) which engage with external teeth of a spur gear 236 (the teeth of the spur gear 236 may be seen, e.g., in FIG. 4). As may be seen in FIG. 8, the motor 226 may be geared down in that an outer diameter of the drive gear 234 may be less than an outer diameter of the spur gear 236. The spur gear 236 may be threaded, e.g., may include internal threads thereon, and may engage external threads 209 on the power screw portion 208 of the finger 206. Thus, the motor 226 may be operable to rotate the drive shaft 232 in a first direction when activated and to turn the drive gear 234 and the spur gear 236, while the spur gear 236 in turn rotates the power screw portion 208 of the finger 206 to move the finger 206 from the zero position to the extended position. The motor 226 may further be operable in a reverse direction, e.g., to rotate the drive shaft 232 in a second direction opposite the first direction, such that the drive gear 234 and spur gear 236 operate to retract the finger 206, e.g., to move the finger 206 from the extended position to the zero position. As will be understood from the foregoing, the finger 206, e.g., the power screw portion 208 thereof, may thus be rotatable about the transverse direction T while also translatable along the transverse direction T to move between the zero position and the extended position when the motor 226 is activated.

Figure 8:
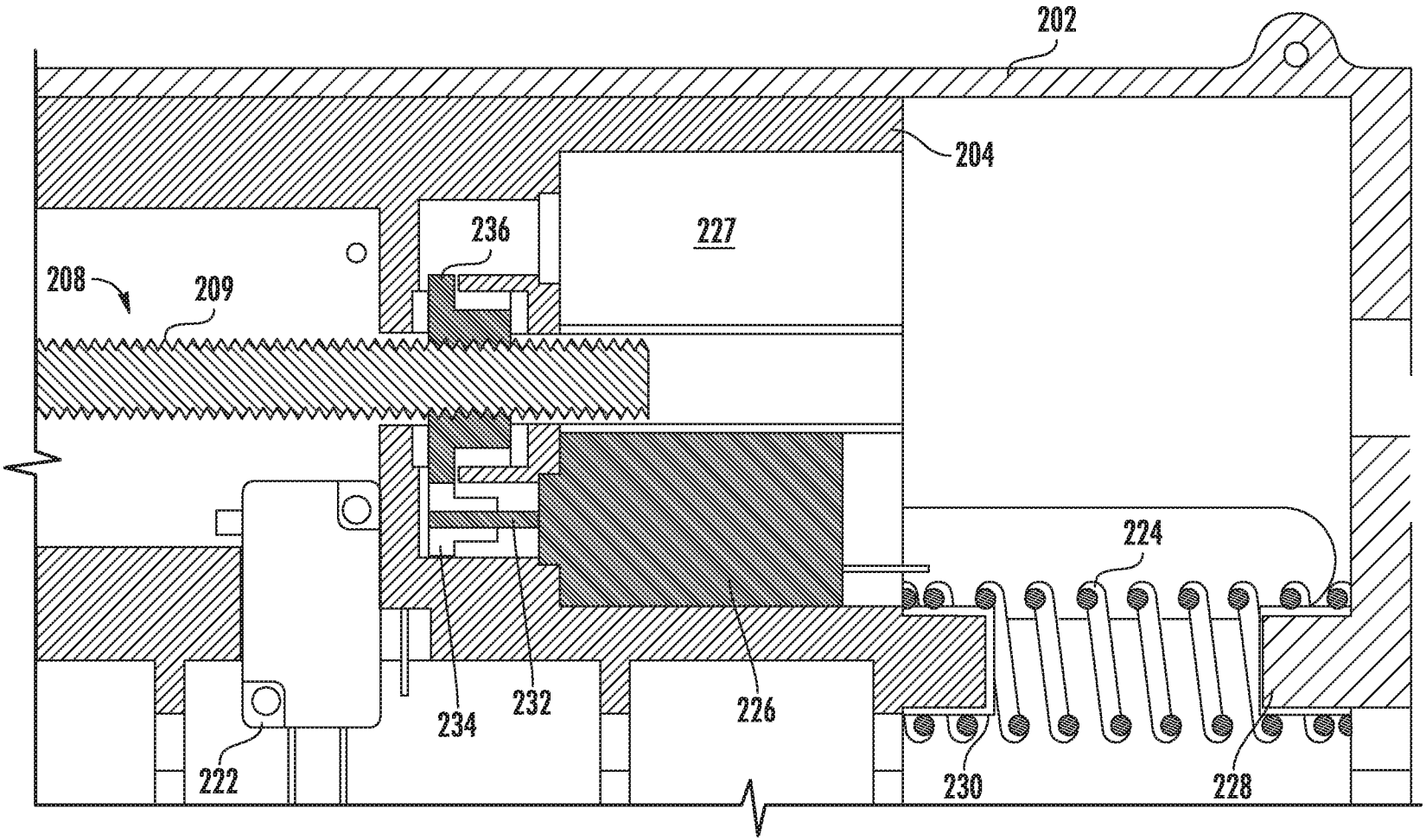
FIG. 8 provides an enlarged top-down section view of a portion of the exemplary door opener of FIG. 4.

In some embodiments, e.g., as illustrated in FIG. 8, the motor 226 may be positioned in a first bay within the inner case 204 and a second bay 227 may also be provided. In at least some embodiments, a second motor 226 may be provided in the second bay 227. Providing a second motor 226 may provide additional power (e.g., for opening/closing the door 124) to the door opener 200 while minimizing an overall size, such as in the vertical direction V, of the door opener 200.

In some embodiments, the door opener 200 may also include a back limit switch 222. Similar to the front limit switch 220 described above, the back limit switch 222 may deactivate or reverse the motor 226 when toggled, e.g., contacted by the translating carriage 218.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a food storage chamber, the food storage chamber extending between a front portion and a back portion along the transverse direction, the front portion of the food storage chamber defining an opening for receipt of food items;

a door positioned at the front portion of the food storage chamber and movable between a closed position and an open position to selectively sealingly enclose the food storage chamber in the closed position and provide access to the food storage chamber in the open position;

a door opener positioned in the cabinet, the door opener comprising an outer case fixedly mounted to the cabinet, an inner case positioned within the outer case and movable relative to the outer case, a finger extending through the inner case and the outer case towards the door, a sensor configured to detect relative movement between the inner case and the outer case, the finger positioned in contact with an inner surface of the door when the door is in the closed position and the door opener is in a zero position, wherein the sensor is configured to detect movement of the inner case from the zero position of the door opener towards the back portion of the cabinet along the transverse direction, and a motor in operative communication with the sensor and the finger, the sensor configured to transmit a signal to the motor when the sensor detects movement of the inner case from the zero position of the door opener towards the back portion of the cabinet along the transverse direction, the motor configured to receive the signal from the sensor, to activate in response to the signal from the sensor, and to move the finger towards the front portion of the cabinet along the transverse direction when the motor is activated.

2. The refrigerator appliance of claim 1, wherein the motor is configured to move the finger relative to the inner case and the outer case when the motor is activated.

3. The refrigerator appliance of claim 1, wherein the finger comprises a front portion extending through the inner case and the outer case and a threaded back portion, wherein the motor is configured to rotate a threaded gear when the motor is activated, the threaded gear engaged with the threaded back portion of the finger, whereby rotation of the threaded gear by the motor moves the finger towards the front portion of the cabinet along the transverse direction.

4. The refrigerator appliance of claim 1, wherein the door opener further comprises a front limit switch in operative communication with the motor, wherein the front limit switch is configured to deactivate the motor when the front limit switch is toggled.

5. The refrigerator appliance of claim 4, wherein the door opener further comprises a translating carriage locked onto the finger, wherein the translating carriage contacts the front limit switch and toggles the front limit switch to deactivate the motor when the finger is in an extended position.

6. The refrigerator appliance of claim 1, further comprising a biasing element extending between the outer case and the inner case, the biasing element configured to bias the inner case and the finger towards a front portion of the outer case.

7. The refrigerator appliance of claim 6, wherein the biasing element is a coil spring.

8. The refrigerator appliance of claim 1, wherein the finger comprises a magnetic tip at a front end of the finger, the magnetic tip of the finger configured to pull the door towards the closed position when the finger moves towards the back portion of the cabinet along the transverse direction.

9. A door opener for a refrigerator appliance, the door opener defining a vertical direction, a lateral direction, and a transverse direction, the vertical, lateral, and transverse directions being mutually perpendicular, the refrigerator appliance comprising a cabinet defining a food storage chamber and a door mounted on the cabinet, the door movable between a closed position and an open position to selectively sealingly enclose the food storage chamber in the closed position and provide access to the food storage chamber in the open position, the door opener comprising:

an outer case configured to be fixedly mounted to the cabinet;

an inner case positioned within the outer case and movable relative to the outer case;

a finger extending through the inner case and the outer case towards the door of the refrigerator appliance;

a sensor configured to detect relative movement between the inner case and the outer case; and a motor in operative communication with the sensor and the finger;

wherein the finger is positioned in contact with an inner surface of the door when the door is in the closed position and the door opener is in a zero position, wherein the sensor is configured to detect movement of the inner case from the zero position of the door opener backward along the transverse direction, and wherein the sensor is configured to transmit a signal to the motor when the sensor detects movement of the inner case from the zero position of the door opener backward along the transverse direction, the motor configured to receive the signal from the sensor, to activate in response to the signal from the linear sensor, and to move the finger forward along the transverse direction when the motor is activated.

10. The door opener of claim 9, wherein the motor is configured to move the finger relative to the inner case and the outer case when the motor is activated.

11. The door opener of claim 9, wherein the finger comprises a front portion extending through the inner case and the outer case and a threaded back portion, wherein the motor is configured to rotate a threaded gear when the motor is activated, the threaded gear engaged with the threaded back portion of the finger, whereby rotation of the threaded gear by the motor moves the finger forward along the transverse direction.

12. The door opener of claim 9, further comprising a front limit switch in operative communication with the motor, wherein the front limit switch is configured to deactivate the motor when the front limit switch is toggled.

13. The door opener of claim 12, further comprising a translating carriage locked onto the finger, wherein the translating carriage contacts the front limit switch and toggles the front limit switch to deactivate the motor when the finger is in an extended position.

14. The door opener of claim 9, further comprising a biasing element extending between the outer case and the inner case, the biasing element configured to bias the inner case and the finger towards a front portion of the outer case.

15. The door opener of claim 14, wherein the biasing element is a coil spring.

16. The door opener of claim 9, wherein the finger comprises a magnetic tip at a front end of the finger, the magnetic tip of the finger configured to pull the door towards the closed position when the finger moves backward along the transverse direction.

17. A door opener for a refrigerator appliance, the door opener defining a vertical direction, a lateral direction, and a transverse direction, the vertical, lateral, and transverse directions being mutually perpendicular, the refrigerator appliance comprising a cabinet defining a food storage chamber and a door mounted on the cabinet, the door movable between a closed position and an open position to selectively sealingly enclose the food storage chamber in the closed position and provide access to the food storage chamber in the open position, the door opener comprising:

an outer case configured to be fixedly mounted to the cabinet;

an inner case positioned within the outer case and movable relative to the outer case;

a finger extending through the inner case and the outer case towards the door of the refrigerator appliance; and a sensor configured to detect relative movement between the inner case and the outer case;

wherein the finger is positioned in contact with an inner surface of the door when the door is in the closed position and the door opener is in a zero position, wherein the sensor is configured to detect movement of the inner case from the zero position of the door opener backward along the transverse direction, and wherein the finger comprises a magnetic tip at a front end of the finger, the magnetic tip of the finger configured to pull the door towards the closed position when the finger moves backward along the transverse direction.

* * * * *